US005577886A

United States Patent [19]

Arbeus

[11] Patent Number: 5,577,886

[45] Date of Patent: Nov. 26, 1996

[54] SEALING DEVICE FOR PUMP IMPELLER

[75] Inventor: Ulf Arbeus, Lidingo, Sweden

[73] Assignee: ITT Flygt AB, Solna, Sweden

[21] Appl. No.: 625,272

[22] Filed: Apr. 1, 1996

Related U.S. Application Data

[63] Continuation of Ser. No. 388,874, Feb. 15, 1995, abandoned.

[51] Int. Cl.[6] ..... F04D 29/16

[52] U.S. Cl. ..... 415/172.1; 415/174.2; 277/188 A

[58] Field of Search ..... 415/172.1, 174.2, 415/174.4; 416/188 R, 188 A

[56] References Cited

U.S. PATENT DOCUMENTS

| | | | |
|---|---|---|---|
| 3,171,334 | 3/1965 | Rasmussen | 277/188 A |
| 3,221,661 | 12/1965 | Swearingen . | |
| 3,228,342 | 1/1966 | Page . | |
| 3,741,679 | 6/1973 | Johnston | 415/172.1 X |
| 4,243,233 | 1/1981 | Arai | 415/172.1 |
| 4,291,890 | 9/1981 | Walker | 277/165 |
| 4,556,364 | 12/1985 | Barker | 415/172.1 |
| 4,674,754 | 6/1987 | Lair et al. | 277/188 A |
| 4,909,707 | 3/1990 | Wauligman et al. | 415/172.1 |
| 4,927,327 | 5/1990 | Keller | 415/172.1 |
| 5,071,318 | 12/1991 | Bice et al. | 415/230 |
| 5,129,795 | 7/1992 | Hyland . | |
| 5,427,498 | 6/1995 | Lehe et al. | 415/172.1 X |

FOREIGN PATENT DOCUMENTS

| | | | |
|---|---|---|---|
| 0167837 | 1/1986 | European Pat. Off. | 415/172.1 X |
| 0492603 | 7/1992 | European Pat. Off. . | |
| 1370318 | 6/1986 | U.S.S.R. . | |

*Primary Examiner*—Edward K. Look
*Assistant Examiner*—Michael S. Lee
*Attorney, Agent, or Firm*—Menotti J. Lombardi

[57] ABSTRACT

The inlet part of the pump housing includes a collar which concentrically surrounds a corresponding opposite collar formed part of the pump impeller inlet, thus permitting any possible leakage flow to be in parallel with the main flow into the impeller and minimizing the disturbance in the main flow. In order to minimize the leakage flow, an O-ring is arranged in front of the opening to a slot between the parts.

1 Claim, 2 Drawing Sheets

SEALING DEVICE FOR PUMP IMPELLER

This application is a continuation of application Ser. No. 08/388,874, filed Feb. 15, 1995, now abandoned.

BACKGROUND OF THE INVENTION

The invention concerns a seal device for sealing off the area between a pump impeller and an adjacent non-rotating part.

In pumps with rotating impellers such as centrifugal pumps, the pumped medium is sucked into the center of the impeller and leaves at the circumference. It is then very important that the inlet part of the impeller is well fitted within the surrounding pump housing in order to prevent pumped medium from flowing back to the inlet. Such a back-flow, which is caused by the higher pressure within the pump housing, means losses and creation of turbulence in the inlet. In addition, pollutions may collect between pump impeller and pump housing inlet.

In order to obtain the necessary sealing between the impeller and non-rotating parts, it is common practice to arrange a wear part, for instance made of rubber, on the non-rotating part and let the impeller glide against that part during rotation. In this way an effective sealing is obtained as long as the wear part is intact. When pumping liquids containing pollutions such as sand, cloth plastic stripes, etc., there is a risk that the slot between seal ring and pump impeller becomes clogged which may cause expensive service work. As the pollutions restrain the rotation of the impeller, the energy consumption increases.

One way to solve the problem is to arrange a mechanical face seal between the impeller and the housing. By designing the sealing so that the seal slot becomes axially directed, quite a good sealing is obtained. A disadvantage is that this solution is comparatively expensive and in addition, considerable losses may occur.

Another way to solve the problem is to arrange a co-rotating O-ring on the impeller inlet part which is influenced by the pressure to glide against the non-rotating surface, the latter then being made of a different material. A relatively good sealing is obtained in this way, but one disadvantage is that the wear may be extensive causing short service intervals. It has also been noted that the O-ring has a tendency to lose its contact. If this occurs, the self-balancing ends and the seal does not function. This depends on the fact that dynamic forces caused by the O-ring are co-rotating.

Still another way to solve the problem is shown in EP-492 603 and U.S. Pat. Nos. 3,228,343 and 3,221,661. Here, the pump inlet is so designed that entering leakage flows are linked in a direction that shall decrease the disturbance of the main in flow.

SUMMARY OF THE INVENTION

According to the invention, a secure and wear resistant device is obtained which minimizes the leakage flow within the pump inlet and which simultaneously decreases the risk for turbulence within the in flow.

BRIEF DESCRIPTION OF THE DRAWINGS

The device is described more closely below with reference to the enclosed drawings in which.

DETAILED DESCRIPTION OF THE PREFERRED EMBODIMENT

Figure 1:
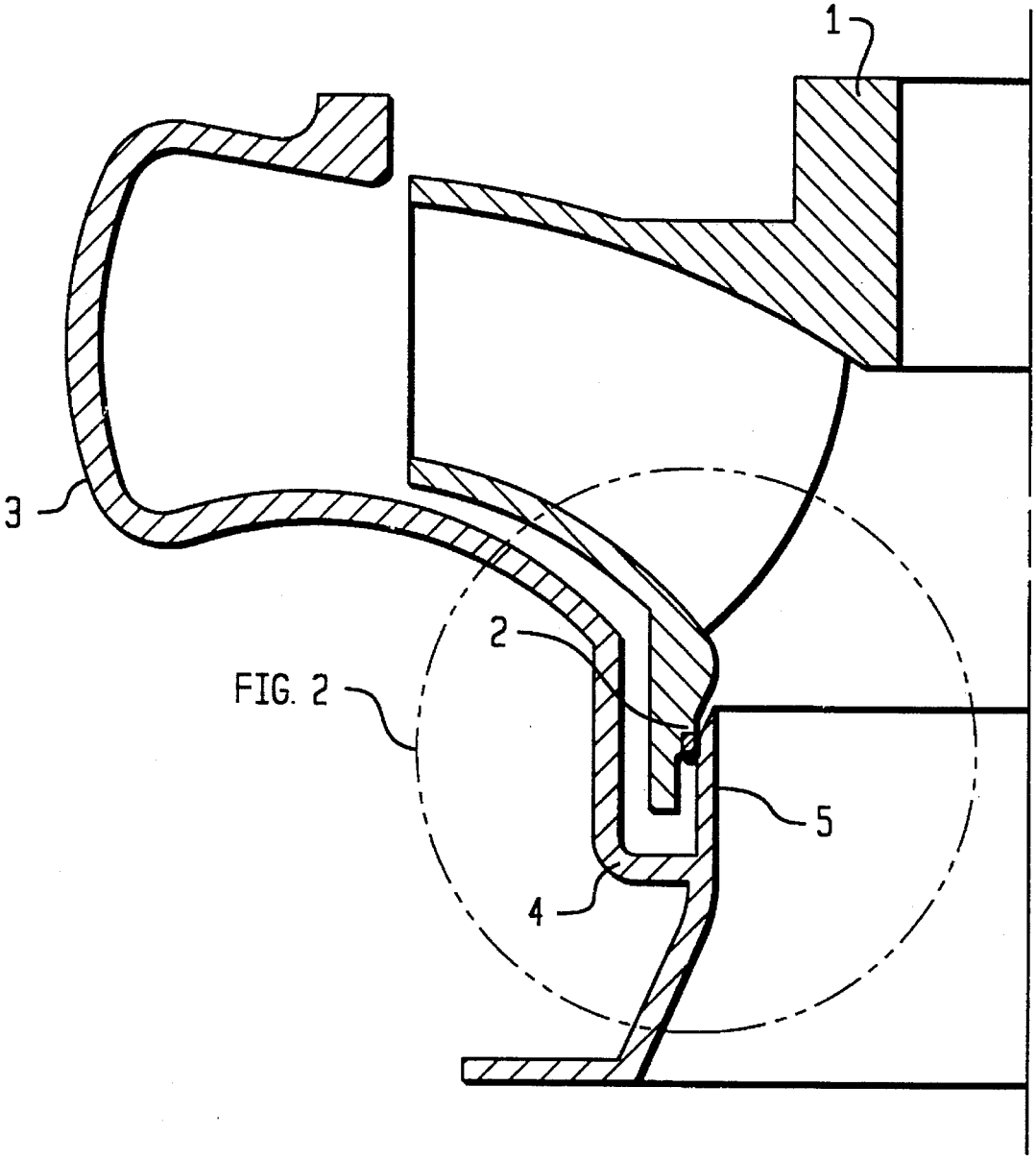
FIG. 1 shows a cut through a part of a pump housing and impeller.
Figure 2:
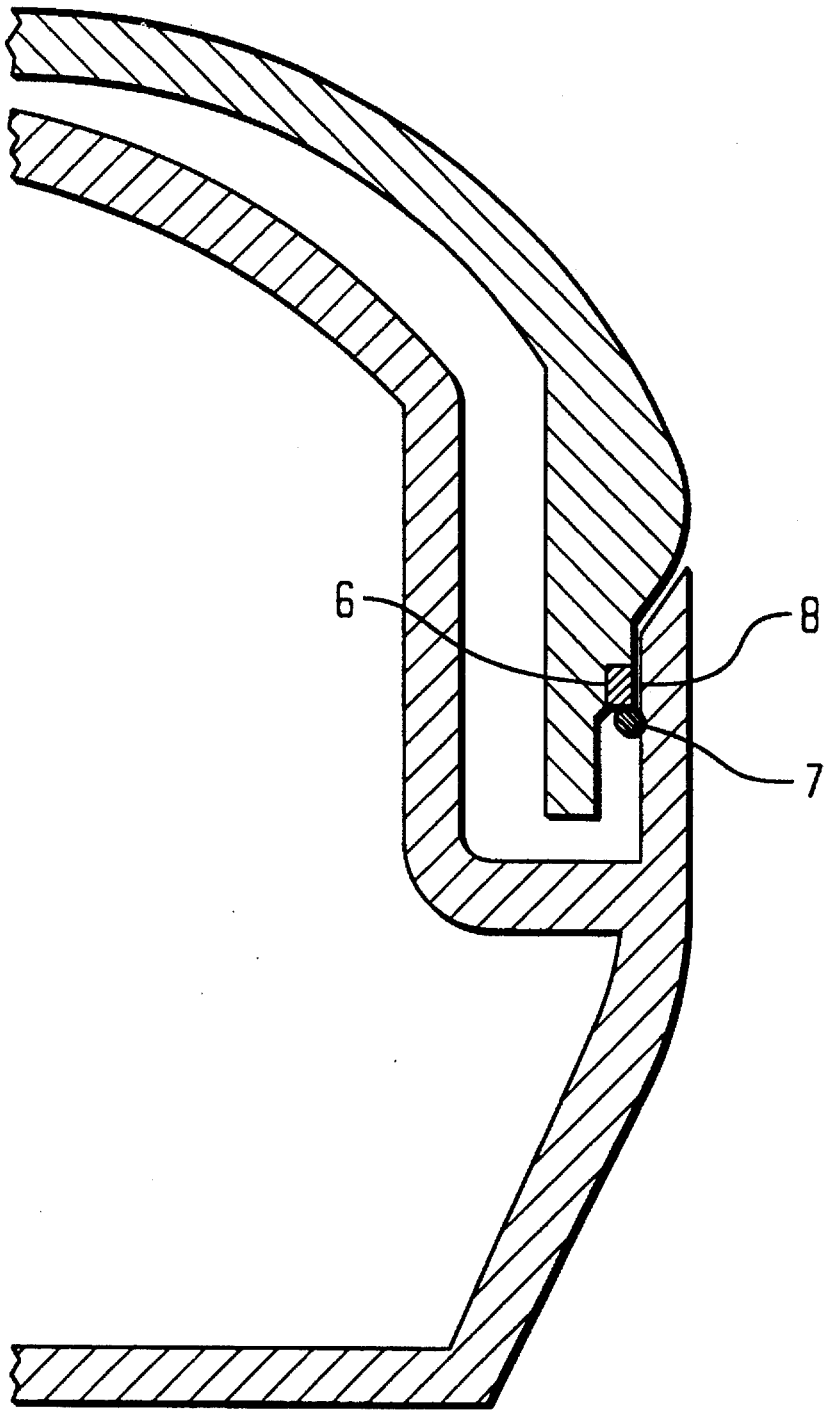
FIG. 2 shows an enlarged view of a cental part.

Referring to the drawings, a pump impeller 1 has an inlet part 2 and a pump housing 3 has a bottom 4 with a collar formed inlet part 5. A wear ring 6, an O-ring 7, and a slot 8 are shown in the enlarged view of FIG. 2.

The pumped liquid is sucked in an axial direction into the centrally located opening of the impeller and leaves the impeller at its circumference. To make it possible for the impeller to rotate freely, a slot having a certain width must be present between the impeller and the inlet part of the pump housing. At the same time there is a wish to make the slot as narrow as possible in order to minimize the back flow from the inner of the pump housing caused by the higher pressure in the latter.

According to the invention, the inlet part 2 of the impeller 1 is provided with a concentric collar which surrounds a similarly collar formed part 5 at the inlet of the pump housing 3 with space therebetween. The part 5 is then directed opposite the collar 2 and extends somewhat into collar 2.

The leakage flow that necessarily occurs is then so linked that it enters the main flow into the impeller almost in parallel, which means that only a minimal disturbance is caused.

In order to further diminish the leakage flow and simultaneously decrease the risk for clogging when pumping polluted liquids, a stationary O-ring 7 is arranged to cover the entrance to the slot 8 between the parts 2 and 5. The O-ring is then attached to the inner non-rotating part 5. It is important that the two parts 2 and 5 extend beyond each other a certain distance to secure a good result.

In order to decrease the wear of the inlet 2 within the area of the slot 8, the impeller is provided with a ring 6 of a wear resistant material on which the O-ring 7 glides.

While I have described above the principles of my invention in connection with specific apparatus, it is to be clearly understood that this description is made only by way of example and not as a limitation to the scope of my invention as set forth in the accompanying claims.

What is claimed is:

1. A device to decrease the back flow through a slot between a pump housing inlet and an impeller, comprising in combination:

said pump housing inlet having an axially directed collar housing part;

said impeller having an axially directed collar impeller part that coaxially surrounds said collar housing part and said collar impeller part having a stepped inner surface;

a flat wear resistant ring being mounted on said stepped inner surface of said collar impeller part and surrounding a portion of said collar housing part, said ring having an inner diameter forming with said portion of said collar housing part, said slot therebetween; and an O-ring being mounted on the outer surface of said collar housing part and being positioned to contact the flat surface of said ring and seal off said slot, thereby leakage flow between said collar housing part and said collar impeller part is minimized.

* * * * *